US005690328A

United States Patent [19]

Herda et al.

[11] Patent Number: 5,690,328

[45] Date of Patent: Nov. 25, 1997

[54] DEVICE FOR DELIVERING PRINTED PRODUCTS FROM A FAN ARRANGEMENT

[75] Inventors: Philippe Herda, Longueil Sainte Marie; Serge Lanvin, Cires Les Mello, both of France

[73] Assignees: Heidelberger Druckmaschinen AG, Heidelberg, Germany; Heidelberg Harris SA, Montataire Cedex, France

[21] Appl. No.: 638,428

[22] Filed: Apr. 26, 1996

[30] Foreign Application Priority Data

Apr. 26, 1995 [FR] France ..... 95/04982

[51] Int. Cl.[6] ..... B65H 29/04

[52] U.S. Cl. ..... 271/204; 271/315

[58] Field of Search ..... 198/470.1, 803.9; 271/204, 307, 277, 315

[56] References Cited

U.S. PATENT DOCUMENTS

| | | | |
|---|---|---|---|
| 1,462,923 | 7/1923 | Stevens | 271/204 |
| 2,773,585 | 12/1956 | Caulfield . | |
| 4,205,837 | 6/1980 | von Hein et al. . | |
| 4,678,172 | 7/1987 | Faltin . | |
| 5,388,820 | 2/1995 | Eberle et al. | 198/803.9 |

FOREIGN PATENT DOCUMENTS

| | | |
|---|---|---|
| 0 033 300 | 8/1981 | European Pat. Off. . |
| 0 541 499 A3/A2 | 5/1993 | European Pat. Off. . |
| 78 09235 | 11/1978 | France . |
| 427 625 | 6/1967 | Switzerland . |
| 2 068 892 | 8/1981 | United Kingdom . |

*Primary Examiner*—H. Grant Skaggs

*Attorney, Agent, or Firm*—Herbert L. Lerner; Laurence A. Greenberg

[57] ABSTRACT

Device for delivering printed products from a fan arrangement for forming a shingled printed-product stream, the device including an endless chain having a revolving path coordinated with the fan arrangement, so that the chain continually pushes, out of pockets of the fan arrangement, printed products received in the pockets, for forming the shingled printed-product stream, further including a holding arrangement for holding the printed products in the pockets, the holding arrangement being formed of grippers disposed on the chain.

8 Claims, 6 Drawing Sheets

DEVICE FOR DELIVERING PRINTED PRODUCTS FROM A FAN ARRANGEMENT

BACKGROUND OF THE INVENTION

1. Field of the Invention

The invention relates to a device for delivering printed products from a fan arrangement for forming a shingled product stream, the device including an endless chain having a revolving path coordinated with the fan arrangement so that, for forming the shingled printed-product stream, the chain continually slides the printed products out of pockets of the fan arrangement wherein printed products have been received and held by a holding arrangement.

A device of this general type has become known heretofore from the published European Patent Document 0 307 889 B1. A fan arrangement is shown therein having several fan wheels disposed on a common axis in mutually spaced axial relationship. Each fan wheel is formed with fan blades disposed at a predetermined distance from one another and defining pockets therebetween for receiving printed products therein. Between the fan wheels, there is arranged at least one endless chain having angle members and clamping members mounted thereon which are disposed at equal distances from one another. On the one hand, the angle members serve as an abutment or stop for the printed products sliding into a pocket and, on the other hand, serve to slide the printed products out of the pocket in a defined direction and to deposit them on a conveying tape, respectively, so that a shingled printed product stream is formed. Furthermore, the clamping member acts upon the upper side of the printed product and presses it onto the underlying fan blade forming the fan pocket. Because the chain and the fan wheel are axially offset with respect to the fan-wheel axis, the printed product is clamped in a scissors-like manner, receiving a "wavelike" profile.

A disadvantage of this heretofore known device is that the printed product is pressed onto the fan blade, and the friction force created thereby obstructs the sliding movement of the printed product out of the pocket. Furthermore, there is a considerable danger that the underside of the printed product may become smudged.

SUMMARY OF THE INVENTION

It is accordingly an object of the invention to provide a device for delivering printed products from a fan arrangement which is gentle to the printed-product material and performs the delivery in a precisely spaced shingled stream of printed products.

With the foregoing and other objects in view, there is provided, in accordance with the invention, a device for delivering printed products from a fan arrangement for forming a shingled printed-product stream, the device including an endless chain having a revolving path coordinated with the fan arrangement, so that the chain continually pushes, out of pockets of the fan arrangement, printed products received in the pockets, for forming the shingled printed-product stream, comprising a holding arrangement for holding the printed products in the pockets, the holding arrangement being formed of grippers disposed on the chain.

In accordance with another feature of the invention, the grippers have a pair of jaws movable towards one another for gripping a respective printed product therebetween.

In accordance with a further feature of the invention, the endless chain comprises a multiplicity of chain links, one of the jaws being formed by a respective one of the chain links, and the device further includes a lever swivelably mounted in the one of the chain links, the other of the jaws being part of the lever.

In accordance with an added feature of the invention, the device includes a spring assigned to the lever for restoring the gripper to an open position thereof.

In accordance with an additional feature of the invention, the device includes a stationary control cam, the lever being formed with a control surface cooperatively engageable with the stationary control cam.

In accordance with yet another feature of the invention, the lever is a double lever, a first arm of the lever forming the other of the jaws, and a second arm of the lever being formed with the control surface.

In accordance with yet a further feature of the invention, the second lever arm is flexible.

In accordance with yet an added feature of the invention, the stationary control cam forms part of a guide path for the chain.

In accordance with yet an additional feature of the invention, the guide path is defined by a U-shaped profile, comprising two legs formed with respective guide grooves for receiving therein respective counterparts on the chain links, and a cross-piece connecting the two legs and forming the stationary control cam.

In accordance with still another feature of the invention, the lever has a swivel shaft, and the counterparts are formed by opposite ends of the swivel shaft.

In accordance with still a further feature of the invention, the chain links are formed, at a longitudinal end thereof whereat the respective chain link is connected to a following chain link, with a nose extending at an inclination to the longitudinal axis of the respective chain link, the nose forming the one of the jaws.

In accordance with a concomitant feature of the invention, the lever has a swivel shaft, and the spring is a torsion spring wound around the swivel shaft, the swivel shaft having respective ends held in the one of the chain links, and the spring being formed with an arm for applying a restoring force to the lever.

The gripper formed on the chain in accordance with the invention offers the advantage that the printed product resting in the fan pocket is subjected only to its own weight. Thus, no additional load or force is exerted on the printed product which could lead to any increased force of impact on the fan blade. This minimizes the counteractive friction force acting on the printed product when it is pushed out of the fan pocket and also protects the underside of the printed product.

The grippers on the chain are preferably formed as jaws moving towards one another for clamping the printed product therebetween, both jaws being located preferably directly opposite one another, so that a scissors-like clamping is avoided.

In a further development of the invention, one jaw is formed by a chain link while the other jaw is part of a lever which is swivelably mounted in the chain link. In this manner the clamping function can be achieved simply by swiveling the lever.

In order to return the lever and therewith the other jaw into an open position, a spring, preferably a torsion spring, is assigned to the lever, the spring being wound around a swivel shaft both ends of which are held in the chain link, an arm of the spring engaging with the lever in a suitable manner.

For the purpose of closing the grippers, the lever is provided preferably with a control surface which comes into contact with a stationary control cam. Thereby, the lever, i.e., the other jaw, is pressed by the control cam against the one jaw formed on the chain link.

The positioning of such a control cam is facilitated by forming the lever as a double lever, with a first lever arm forming the other jaw, and the second lever arm, which preferably projects from the opposite side of the chain link, providing the control surface.

The second lever arm is preferably flexible, so that the printed products are clamped with a force determined by the flexibility of this second lever arm. Furthermore, printed products of varying thickness can be gripped by such a flexible lever arm without any necessity for changing the control cam.

In order to prevent a deflection of the chain in the vicinity of the control cam due to the force applied to the control surface by the control cam, a guide is provided for the chain in the vicinity of the control cam, in accordance with a further development of the invention. This guide is formed preferably of a U-shaped profile, the two legs of which are provided with grooves extending in longitudinal direction, and projections formed on each chain link, preferably the two ends of the swivel shaft of the lever or the two ends of a chain pin, engaging in the grooves. This guide offers the additional advantageous effect that the chain in this region cannot be caused to vibrate, which would otherwise lead to unequal spacings in the shingled product stream.

Other features which are considered as characteristic for the invention are set forth in the appended claims.

Although the invention is illustrated and described herein as embodied in a device for delivering printed products from a fan arrangement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
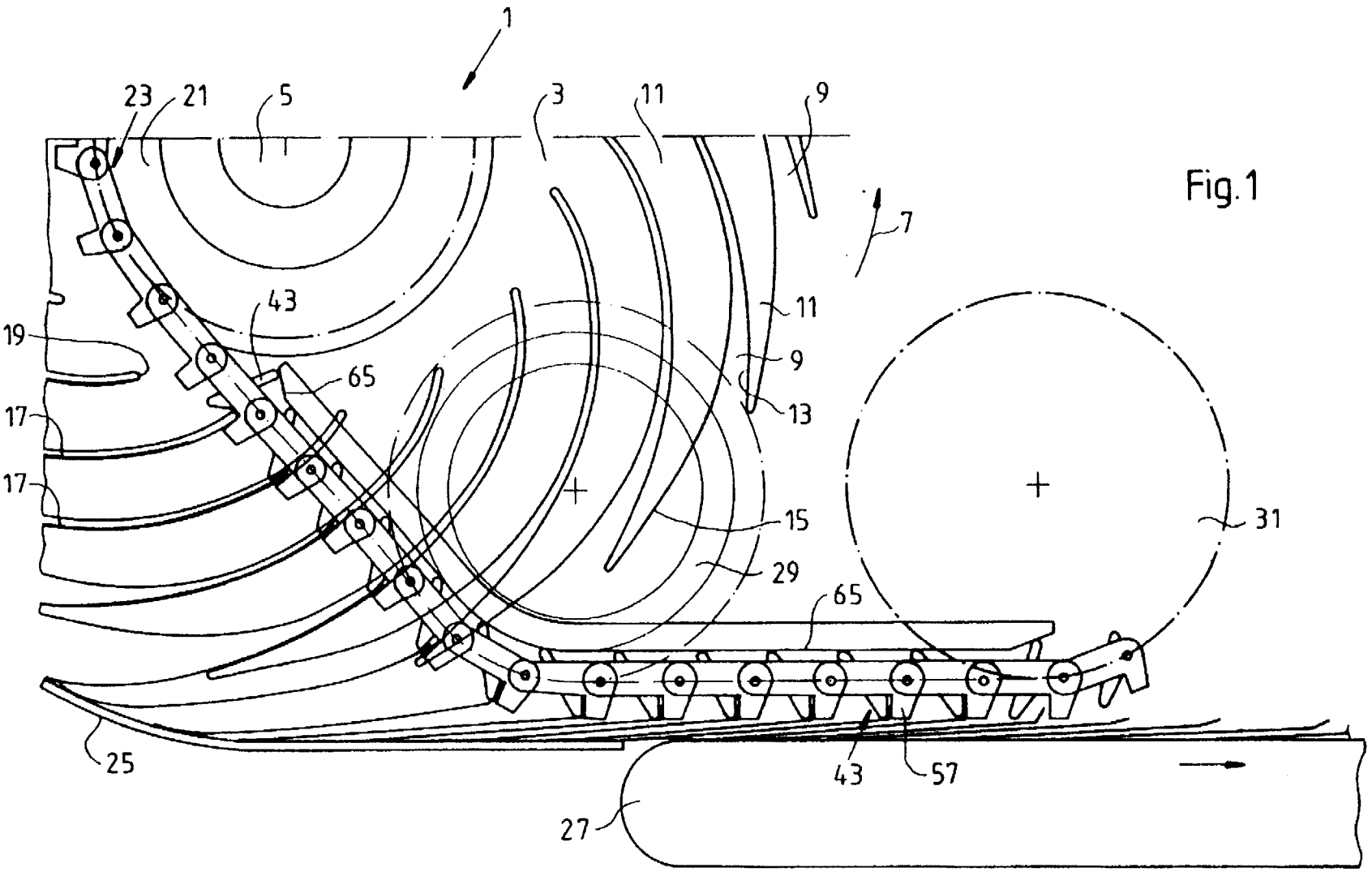
FIG. 1 is a fragmentary, diagrammatic side elevational view of a fan arrangement in the vicinity of a printed-product delivery.

Referring now to the drawing and, first, particularly to FIG. 1 thereof, there is shown therein a fan arrangement 1 in the vicinity of the printed-product delivery of a printing press. The fan arrangement 1 includes at least one fan wheel 3, hereinafter also referred to as a fan, which is rotatable by a drive shaft 5 in a direction of rotation indicated by an arrow 7. In the fan wheel 3, pockets 9 are formed which are defined by fan blades 11 in circumferential direction of the fan wheel 3. An inner contour 13 of a fan blade 11 and an opposing outer contour 15 of an adjacent fan blade 11 form an entry funnel which facilitates the entry of a printed product 17 into the respective pocket 9. Due to the arcuate shape of the fan blades 11, the pockets 9 are provided with a profile which causes a slow-down of the printed products 17 as they slide into the respective pockets 9 and before they hit the base 19 of the respective pockets 9. A chain or sprocket wheel 21 driving an endless chain 23 is disposed on the drive shaft 5 and is spaced from the fan wheel 3 in longitudinal direction. The precise configuration of the chain 23 will be described in detail hereinafter.

A repository 25 whereon an overlapping or shingled printed-product stream is deposited, at least in part, is disposed below the fan 3. An end section of the repository 25 initially coming into contact with the printed products 17 has an arcuate shape, in order to keep the spacing thereof from the adjacent fan blade 11 at a minimum. This arcuate section, however, changes into a horizontally extending section meeting at an end thereof, with a conveyor tape or belt 27. On this conveyor tape 27, the printed products 17 are all deposited at defined distances from one another and, as a shingled printed-product stream, are transported in the direction indicated by an associated arrow to a successive processing station.

The chain 23 is guided to the rim of the fan 3 and diagonally downwardly in a direction towards the conveying tape 27 and, in the vicinity of the horizontal section of the repository 25, the chain 23 is guided further by a guide roller 29 into a horizontal plane in parallel with the conveying tape 27. In the further course thereof, the chain 23 is led away from the conveyor tape 27 and back to the chain wheel 21 by a further deflector or guide roller 31.

The chain 23 is formed of individual chain links 33 which are swivelably connected to one another by chain pins 35. A detailed illustration of a chain link 33 is provided in FIG. 2.

Each chain link 33 is formed of a base member 36 formed with a cavity 42, so that side walls 37 are created which are comparable with the side bars or straps of a conventional chain. At a longitudinal end of the base member 36, a projection 39 is formed for receiving a chain pin 35. The length of the chain pin 35 is chosen somewhat greater than the width of the base member 36, so that the chain pin 35 will be able to cooperate with a guide described in detail hereinafter. The chain pin length otherwise corresponds to the width of the base member 36.

A downwardly opening recess 41 is formed in the other longitudinal end of the base member 36, for receiving therein the suitably insertable projection 39 and the chain pin 35 of the succeeding chain link 33. The recess 41 is of such dimensions as to provide a snap-connection.

These chain links 33, which are preferably formed of synthetic material, can be joined in very simple manner, so that the chain 23 used in the fan-wheel arrangement 1 can be easily made longer or shorter.

In the free space 42 formed between the chain pin 35, both side walls 37 and the projection 39, a lever 43 is disposed which is swivelably connected to the side walls 37 by means of a swivel shaft 45. In the interest of clarity the lever 43 is not shown in FIG. 2*b*.

The lever 43 extends completely through the free space 42 and projects from both sides of the chain link 33. A resetting force is applied to the lever 43 by means of a spring 47, preferably a torsion spring, which biases the lever into a base position thereof represented in phantom in FIG. 2a.

Figure 3:
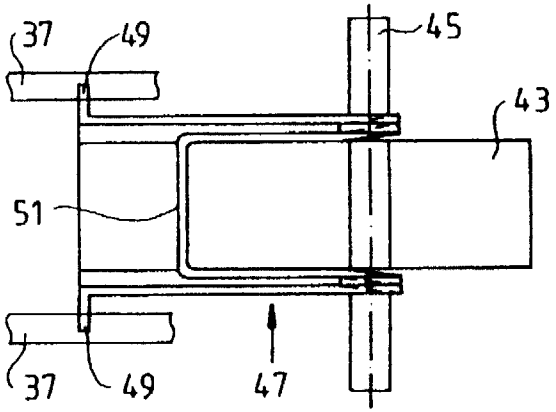
FIG. 3 is a fragmentary top plan view of FIG. 2*a;*
Figure 4:
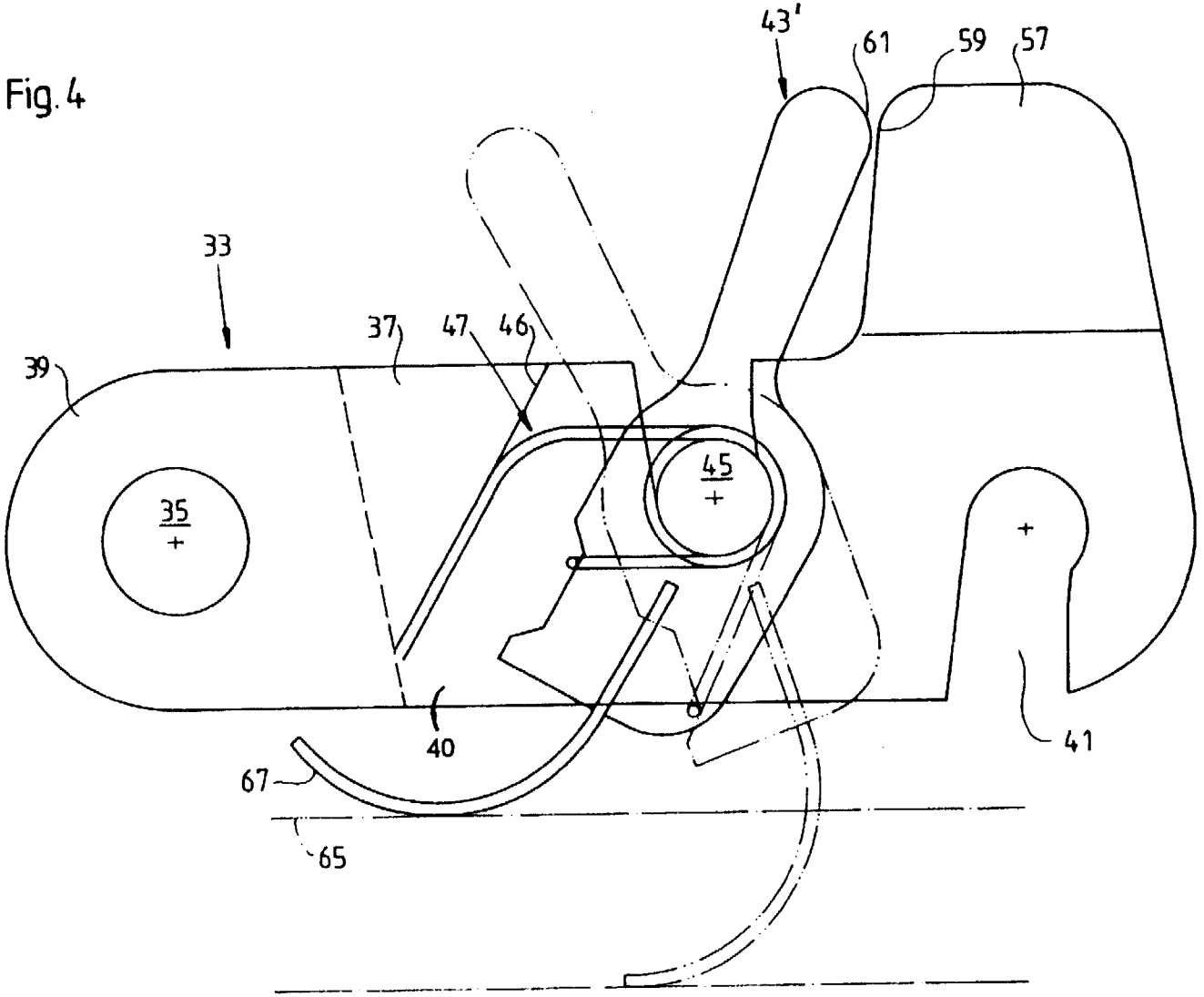
FIG. 4 is an enlarged view of FIG. 2*a* showing a different embodiment of the chain link according to the invention.

A top plan view of the spring 47 is shown in FIG. 3. In this regard, it is believed to be apparent that the spring 47 is a torsion spring which is wound around the swivel shaft 45 at both sides of the lever 43, both ends 49, respectively, of the thus formed two parallel windings of the torsion spring 47 engaging below a side wall 37, so that these ends 49, when the spring 47 is subjected to tension, can brace themselves against the counter-bearing side wall 37 and cannot escape. Of course, the two ends 49 can also brace themselves at another suitable location, e.g., against a side wall 40 defining the cavity 42, as shown in FIG. 4.

A bracket 51 connecting the two windings of the spring 47 acts upon the lever 43 so as to bias it to return to the base or starting position thereof. On the other hand, this base or starting position of the lever 43 is limited or defined by a stop 53 formed by the end of the projection 39 of the next following chain link 33, as is apparent from FIG. 2a. The spring 47 presses the lever 43 against the stop 53 at an abutment surface 55 of the lever 43 formed specifically for this purpose.

The chain link 33 is provided, at the end thereof formed with the recess 41, with an upwardly projecting nose 57, and a side surface 59 of the nose 57 directed towards the middle of the chain link 33 serves as an abutment or stop for the lever 43, when the lever 43 is moved against the bias of the spring 47. Consequently, due to the interaction or cooperation of the lever 43 and the side surface 59, a gripper device is created, with the side surface 59 serving as a first jaw thereof and the section of the lever 43 facing towards this side surface 59 serving as a second jaw 61 thereof. Between these jaws, a printed product, for example, can then be clamped.

Figure 2A:
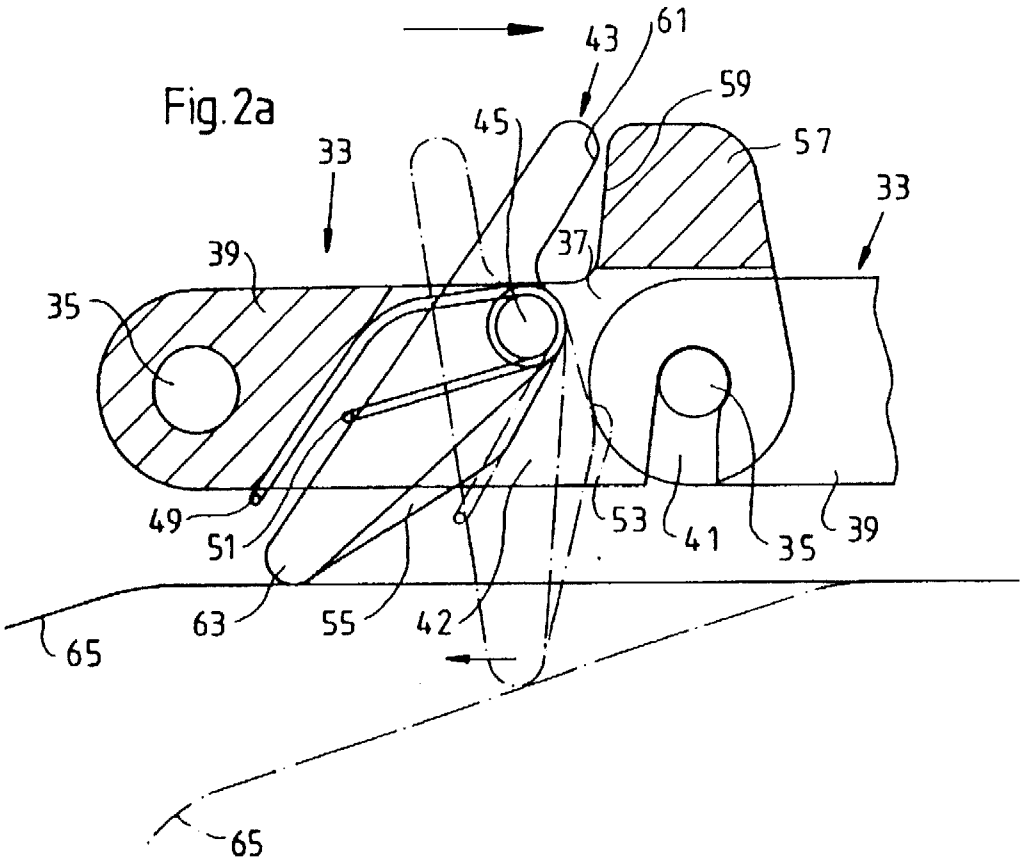
FIG. 2*a* is an enlarged fragmentary view of FIG. 1 showing an individual chain link of an endless chain conveyor thereof.
Figure 2B:
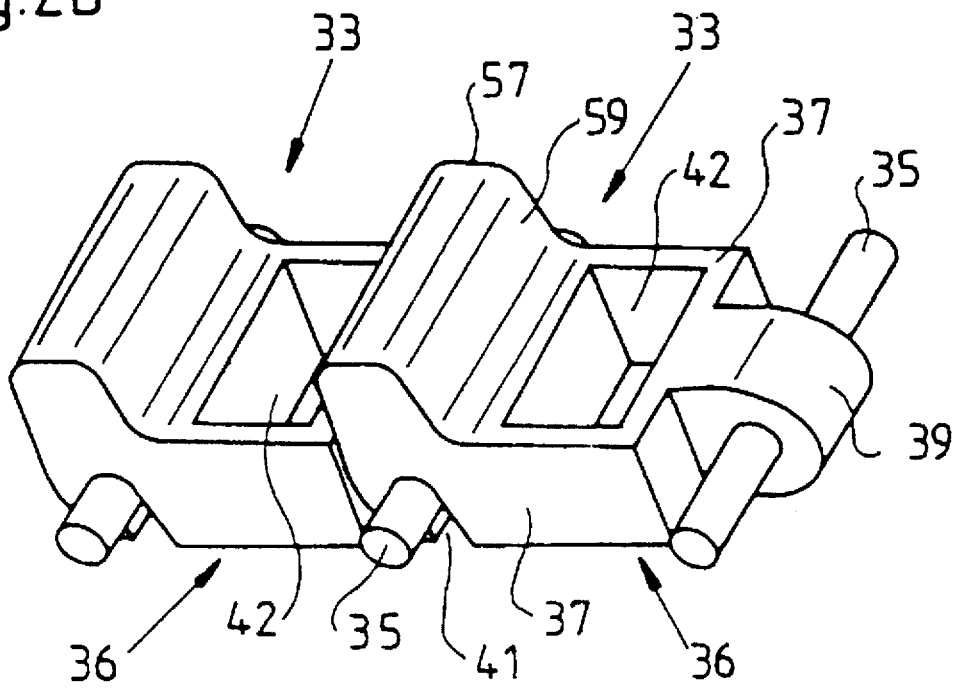
FIG. 2*b* is a perspective view of two jointed chain links of the endless chain conveyor.

The clamping movement of the lever 43, i.e., a rotation of the lever 43 about the swivel shaft or pin 45 in a clockwise direction, as viewed in FIG. 2a, results in the end 63 of the lever 43 located opposite to the second jaw or end 61 thereof moving or running onto a stationary control cam 65.

The clamping device formed of the two jaws 59 and 61 closes when the lever end 63 serving as a control surface runs onto an initially inclined control cam 65, as represented in phantom in FIG. 2a, in the direction of the arrow during the movement of the chain link 33. Due to the continual reduction of the distance between the swivel shaft 45 and the control cam 65 upon movement of the chain, the lower lever arm with the control surface 63 is pressed backwards opposite to the transport direction of the chain 33 and is consequently turned in a clockwise direction, as viewed in FIG. 2a. The second jaw 61 formed on the other lever arm then approaches the first jaw, that is, the side surface 59 of the nose 57. When the desired end position is reached, the control cam 65 extends farther in parallel with the transport direction of the chain link 33, with a constant clamping force being maintained.

The instant the control surface 63 loses contact with the control cam 65, at the end of the clamping, the lever 43 is returned to the base or starting position thereof by the restoring force of the spring 47.

FIG. 4 shows another embodiment of the lever 43, wherein the chain link 33 as such is identical with the chain link 33 of FIG. 2a described hereinbefore. Thus, those parts of FIGS. 4 and 2a identified by the same reference numerals will not be described again hereinafter.

Contrary to the herein aforedescribed lever 43, the lever 43' shown in FIG. 4 has a lever arm 67 formed with a flexible control surface. By the selection of a suitable material and suitable profiling for this arcuately shaped, flexible lever arm 67, an adjustment and predetermination, respectively, of the pressing force exerted by the jaw 61 against the opposite jaw 59 is permitted.

Thus, the achievement of a uniform clamping force is no longer dependent upon maintaining a precisely defined spacing between the control cam 65 and the swivel shaft or axis 45, as is the case in the exemplary embodiment illustrated in FIG. 2a. The minimum distance between the control cam 65 and swivel axis 45 can consequently be selected to be below a given tolerance range. Printed products of varied thickness can then be clamped without having to change the control surface.

Described in detail hereinafter with respect to FIG. 1 is the interaction or cooperation of the chain 23 and the fan wheel or fan 3.

Initially, for example, a previously folded printed product 17 is delivered into a pocket 9 of the fan 3, the printed product 17 sliding in until reaches the pocket base 19. Then, the edge of the printed product 17 resting on the pocket base 19 butts against the side Of the chain link 33 formed with the nose projection 57. This is accomplished by the rotation of the fan wheel 3 and by the movement of the chain 23 diagonally, i.e., at an inclination, with respect to the rim of the fan wheel 3.

Due to a longitudinal expansion or extension of the individual chain links 33, an expansion which is dependent upon the distance between the individual pockets 9, the printed product 17 comes to lie between the nose projection 57 the lever am 43 having the jaw 61 and being disposed in the base position thereof. Due to a downwardly directed movement of the chain 23 and the rotational movement of the fan wheel 3, the printed product 17 is pushed slowly out of the fan pocket 9 and initially deposited partly on the repository 25. Simultaneously, the clamping function described with respect to FIG. 2a is performed, the control surface of the lever 43 moving onto the control cam 65, and the leading or front edge of the printed product 17 being clamped between the two jaws 59 and 61.

By means of this clamping function, the printed product 17 does not slide out of the fan pocket 9 too fast, which would otherwise lead to an irregularity in the stream of shingled printed products 17.

In the exemplary embodiment illustrated in FIG. 1, the printed product 17 remains clamped between the jaws 59 and 61 even after it leaves the fan pocket 9. The printed product 17 initially supported by the repository 25 is pulled in the direction of the conveyor tape 27 by the chain 23, further transport of the printed product 17 being thereafter assisted by the conveyor tape 27. Only when the printed product 17 is resting completely on the conveyor tape 27 is the clamping released and the printed product 17 accordingly set free. When the speed of the conveyor tape 27 is adapted or matched to the speed of the chain 23, a shingled product stream is formed wherein the spacing of the printed products 17 may be adhered to very precisely.

Figure 5:
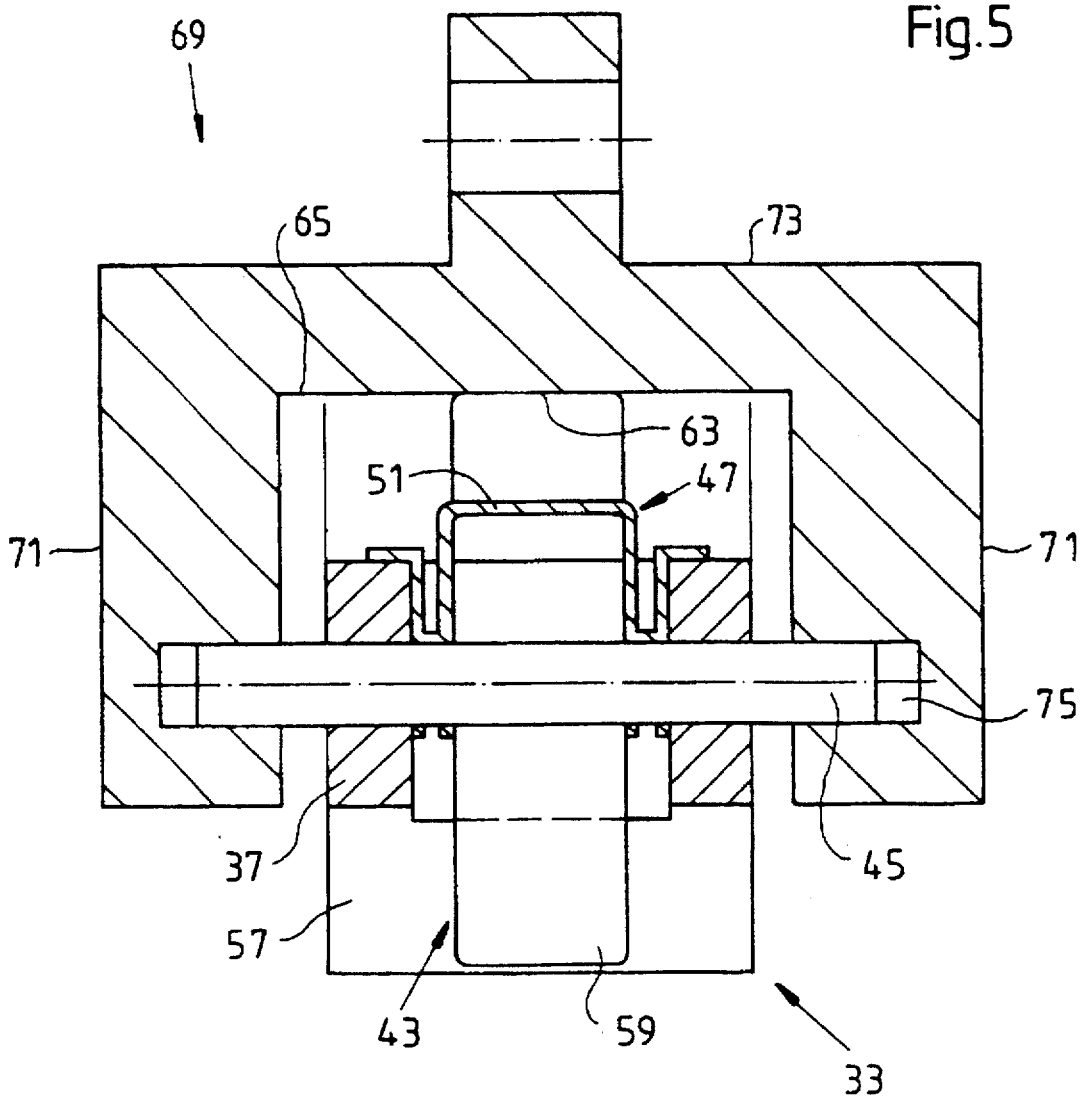
FIG. 5 is a cross-sectional view taken along a plane passing through the conveyor chain and a guide path therefor.

FIG. 5 shows an exemplary embodiment of a guide for the chain 23, which is provided especially for that section of the chain travel path wherein the clamping of the printed products 17 takes place, i.e., in the vicinity of the control cam 65.

The guide 69 is formed of a U-shaped profile with two legs 71 and a cross-piece 73. The inner side of each leg 71 is formed with a groove 75 extending in transport direction of the chain 23, i.e., in the plane of the drawing of FIG. 5. Respective projections or prolongations of the chain link 33, preferably the two laterally projecting ends of either the swivel shaft 45 or the chain pin 35, engage in the grooves 75.

The inner surface of the cross-piece 73 serves as a control cam 65 which cooperates with the control surface 63 formed on the lever arm 43, as has been explained in connection with the figures described hereinbefore.

The guidance of the chain link 33 in the groove 75 prevents the chain link 33 from deflecting downwardly due to the force applied to the control surface 63 by the control cam 65. Moreover, a slackening and vibrating, respectively, of the chain 23 is effectively prevented thereby.

At the starting end of the control cam 65, the grooves 75, as viewed in circumferential direction of the chain 23, may be opened in a funnel-shaped manner, in order to facilitate the entry of the two ends of the swivel shaft 45 into the grooves 75

Figure 6:
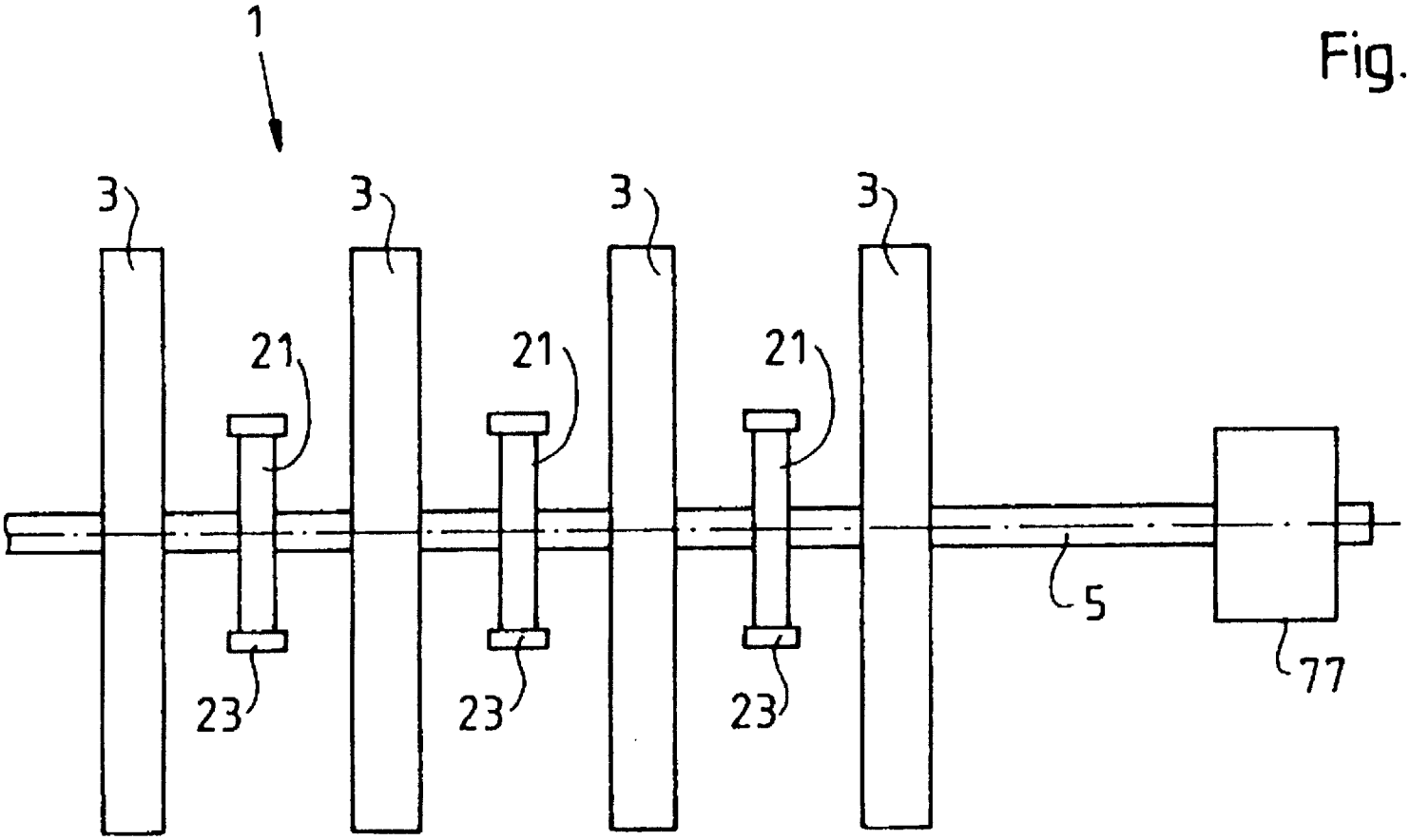
FIG. 6 is a highly diagrammatic axial view of a fan arrangement according to the invention.

FIG. 6 is a diagrammatic illustration of a fan arrangement 1 made up of multiple fans or fan wheels 3 mounted on a drive shaft 5, with chain or sprocket wheels 21 located therebetween, the drive shaft 5, and the chain wheels 21 and the fans 3 therewith being driven, for example, by a belt drive 77.

It is believed to be readily apparent that the invention of the instant application may also be applied to other fan arrangements having only two or three, or more than the four fans shown herein, wherein it may be sufficient to provide only one chain with the grippers.

We claim:

1. Device for delivering printed products from a fan arrangement for forming a shingled printed-product stream, the device including an endless chain having a revolving path coordinated with the fan arrangement, so that the chain continually pushes, out of pockets of the fan arrangement, printed products received in the pockets, for forming the shingled printed-product stream, comprising:

a holding arrangement for holding the printed products in the pockets, said holding arrangement being formed of grippers disposed on the chain;

said grippers having a pair of jaws movable towards one another for gripping a respective printed product therebetween;

the endless chain having a multiplicity of interconnected chain links, one of said jaws being formed by a respective one of said chain links, and including a lever swivelably mounted in said one of said chain links, the other of said jaws being part of said lever; and said lever is a double lever, a first arm of said lever forming said other of said jaws for clamping the printed product, and a second arm of said lever being formed with a control surface for actuating said lever.

2. Device according to claim 1, including a stationary control cam, and wherein said lever is formed with said control surface cooperatively engageable with said stationary control cam.

3. Device according to claim 2, wherein said stationary control cam forms part of a guide path for the chain.

4. Device according to claim 1, wherein said second lever arm is flexible.

5. Device according to claim 1, wherein said chain links are formed, at a longitudinal end thereof whereat the respective chain link is connected to a following chain link, with a nose extending at an inclination to the longitudinal axis of the respective chain link, said nose forming said one of said jaws.

6. Device for delivering printed products from a fan arrangement for forming a shingled printed-product stream, the device including an endless chain having a revolving path coordinated with the fan arrangement, so that the chain continually pushes, out of pockets of the fan arrangement, printed products received in the pockets, for forming the shingled printed-product stream, comprising:

a holding arrangements for holding the printed products in the pockets, said holding arrangement being formed of grippers disposed on the chain;

said grippers having a pair of jaws movable towards one another for gripping a respective printed product therebetween;

the endless chain having a multiplicity of chain links, one of said jaws being formed by a respective one of said chain links, and including a lever swivelably mounted in said one of said chain links, the other of said jaws being part of said lever;

a stationary control cam forming part of a guide path for the endless chain;

said lever having a control surface cooperatively engaging said stationary control cam; and said guide path having a U-shaped profile, said U-shaped profile having two legs forming respective guide grooves for receiving therein respective counterparts on said chain links, and a cross-piece connecting said two legs and forming said stationary control cam.

7. Device according to claim 6, wherein said lever has a swivel shaft, and said counterparts are formed by opposite ends of said swivel shaft.

8. Device for delivering printed products from a fan arrangement for forming a shingled printed-product stream, the device including an endless chain having a revolving path coordinated with the fan arrangement, so that the chain continually pushes, out of pockets of the fan arrangement, printed products received in the pockets, for forming the shingled printed-product stream, comprising:

a holding arrangement for holding the printed products in the pockets, said holding arrangement being formed of grippers disposed on the chain;

said grippers having a pair of jaws movable towards one another for gripping a respective printed product therebetween;

the endless chain having a multiplicity of chain links, one of said jaws being formed by a respective one of said chain links, and including a lever swivelably mounted in said one of said chain links, the other of said jaws being part of said lever;

a spring assigned to said lever for restoring said gripper to an open position thereof; and said lever has a swivel shaft, and said spring is a torsion spring wound around said swivel shaft, said swivel shaft having respective ends held in said one of said chain links, and said spring being formed with an arm for applying a restoring force to said lever.

* * * * *